United States Patent [19]

Patterson

[11] Patent Number: 4,668,183

[45] Date of Patent: May 26, 1987

[54] LIFTING ELEMENT FOR PIPE COOLERS FOR MATERIAL PRODUCED AT LEAST PARTIALLY IN LUMPS

[75] Inventor: Jochen Patterson, Kelmis, Belgium

[73] Assignee: Gieberei Kohlscheid GmbH, Herzogenrath, Fed. Rep. of Germany

[21] Appl. No.: 800,343

[22] Filed: Nov. 21, 1985

[30] Foreign Application Priority Data

Nov. 29, 1984 [DE] Fed. Rep. of Germany ..... 8434907

[51] Int. Cl.[4] ..... F27B 7/14; B02C 17/22

[52] U.S. Cl. ..... 432/80; 432/118; 241/181; 241/183

[58] Field of Search ..... 432/103, 110, 118, 77, 432/80; 34/135, 136; 241/181, 183

[56] References Cited

U.S. PATENT DOCUMENTS

| | | | |
|---|---|---|---|
| 3,521,867 | 7/1970 | Bucchi | 432/118 |
| 3,780,447 | 12/1973 | Fales | 34/136 |
| 3,808,701 | 5/1974 | Bachmann | 34/136 |
| 3,809,528 | 5/1974 | Kramm | 432/80 |
| 3,853,458 | 12/1974 | Wurr et al. | 432/118 |
| 3,869,247 | 3/1975 | Deussner | 432/80 |
| 4,131,418 | 12/1978 | Kramm | 432/80 |
| 4,172,701 | 10/1979 | Bernt | 432/118 |

*Primary Examiner*—Henry C. Yuen

*Attorney, Agent, or Firm*—Mason, Fenwick & Lawrence

[57] ABSTRACT

A lifting element (5) for pipe coolers for material produced at least partially in lumps, e.g. clinker, has a mounting portion (8) fixed to the shell (1) of the pipe cooler, and a carrier portion (9) which extends essentially at right angles thereto and comprises at least one aperture (15; 24,25) passing through it. It may be of fork-like construction, with each aperture (24, 25) located between two tines (21, 22, 23).

3 Claims, 7 Drawing Figures

Figure 1:
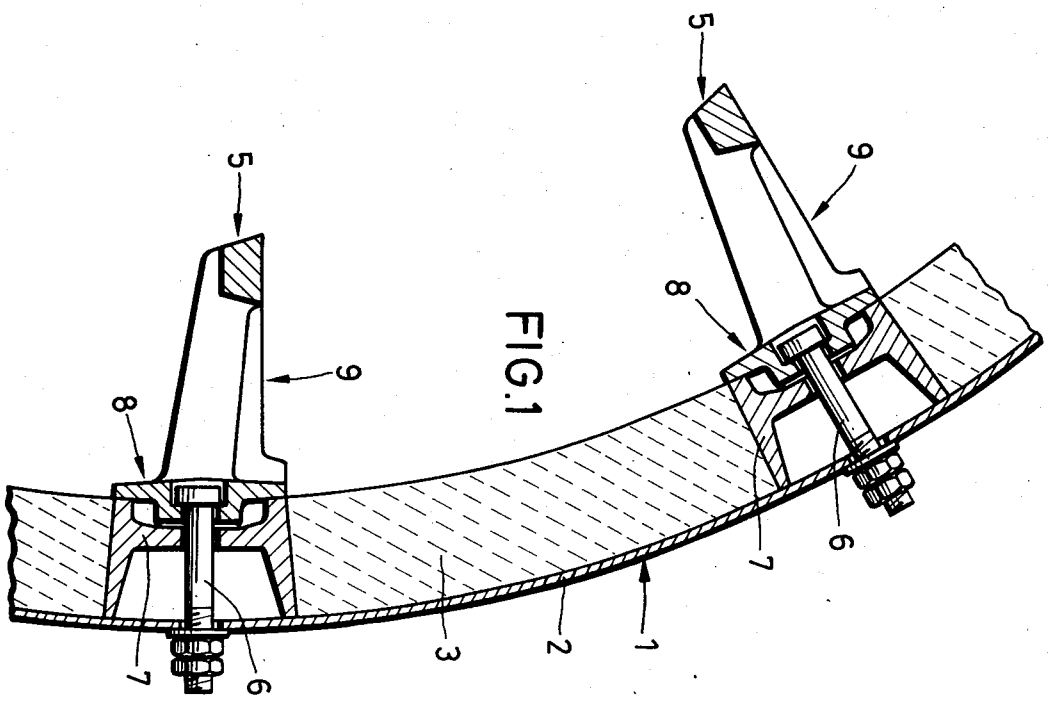

LIFTING ELEMENT FOR PIPE COOLERS FOR MATERIAL PRODUCED AT LEAST PARTIALLY IN LUMPS

The invention relates to a lifting element for pipe coolers for material produced at least partially in lumps, e.g. clinker, which comprises a mounting portion which can be fixed to the shell of the pipe cooler, and a carrier portion extending essentially at right angles thereto.

Lifting elements of this kind are fixed to the shell of a pipe cooler directly, or with intermediate mountings.

In pipe coolers of this kind, the material to be cooled is entrained to a greater or lesser extent by lifting elements fixed to the pipe shell when the pipe cooler rotates, in order then to fall off these lifting elements and at the same time come into intimate contact with cooling air.

The material is conveyed in the pipe cooler on account of a tilt towards the outlet.

The pipe coolers may be constructed as drums, and combined as so-called planetary or satellite coolers to form a cooling unit.

Coolers of this kind are required e.g. for cooling clinker in cement manufacture.

In the first region of a pipe cooler, the material to be cooled is as a rule both in fine form and in the form of larger or smaller lumps. In this first region of the pipe cooler, lifting beams or bars are used which are mounted on the shell of the pipe cooler and have an enclosed carrier surface essentially facing towards the centre of the pipe cooler. It can be observed that only the fine fraction of the material accumulates on the carrier surface, starting from the respective angle of repose. This fine material on the carrier surface to a large extent prevents the lifting elements from also entraining coarser material or lumps. The consequence of this is that the material in lump form is not entrained sufficiently and is not cooled to the required extent. Furthermore, it follows that due to deficient entrainment of the lump-like material, the desired fragmentation of this material does not occur to a sufficient extent, since this fragmentation depends on the lumps of material falling, which in turn happens only if the lumps have been carried to an elevated position. With the lifting elements known hitherto, therefore, there is the disadvantage that lumps are carried into the subsequent regions of the pipe cooler without being cooled sufficiently. This inadequate cooling may have disadvantages for the material itself. Furthermore, however, the presence of lumps in the subsequent regions readily results in extensive wear and destruction of the lifting elements located in these regions.

It is the object of the invention to provide a lifting element of the kind mentioned hereinbefore, with which material produced in lumps can be entrained and broken in the first region of a pipe cooler.

This object is achieved according to the invention, with a lifting element of the kind mentioned hereinbefore, by the fact that the carrier portion has at least one aperture passing through this portion.

The aperture or apertures provided in the carrier portion cause fine material to fall through the aperture or apertures in the carrier portion and thus not to fill up the carrier surface, so that this carrier surface can also entrain lumps of the material to be cooled when the pipe cooler rotates. In this case, breaking of the lumps occurs in the region of the pipe cooler provided therefor, and hence wear in the subsequent zones of the cooler is reduced. It may be appropriate to use, in addition to the lifting elements according to the invention, those of the kind known hitherto in a ring. Furthermore, it is possible to provide a ring only with the lifting elements according to the invention, and to provide one or more of the adjacent rings with lifting elements of the known kind.

The invention further provides that the carrier portion is of fork-like construction, and each aperture is located between two tines originating at the mounting portion.

The invention further provides that at least two tines are provided.

The lifting element according to the invention may further be constructed in such a way that the aperture of the carrier portion is encompassed by an essentially U-shaped breaker frame with its two arms originating at the mounting portion. The use of such a breaker frame can increase the impact strength of the lifting element and hence the strength to withstand falling lumps.

The lifting element according to the invention may further be constructed in such a way that the aperture encompassed by the breaker frame is divided by at least one rib. The impact strength of the carrier portion can be promoted and also the entrainment effect can be increased by ribs of this kind.

In the following part of the specification, two embodiments of the lifting element according to the invention are described with reference to drawings.

Figure 2:
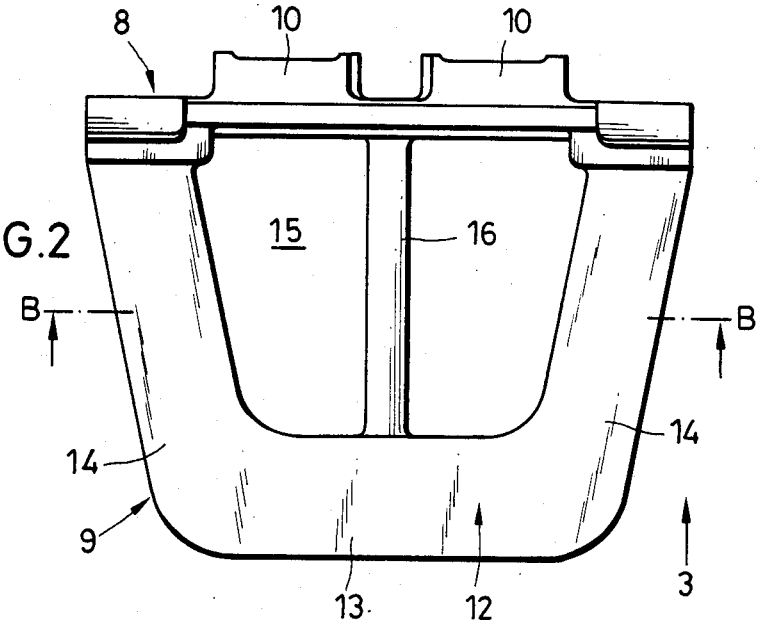
Figure 3:
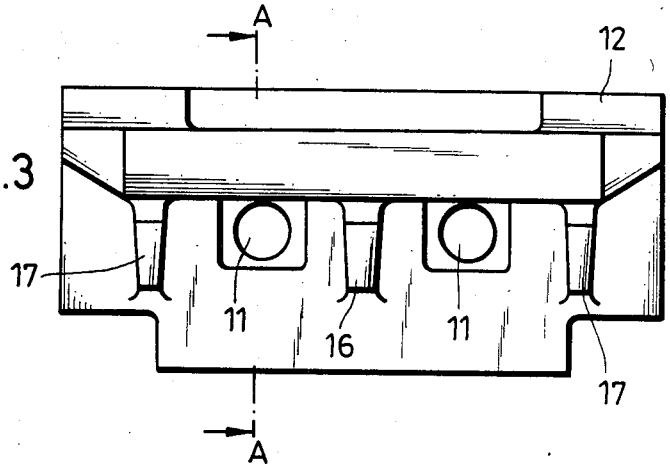
Figure 4:
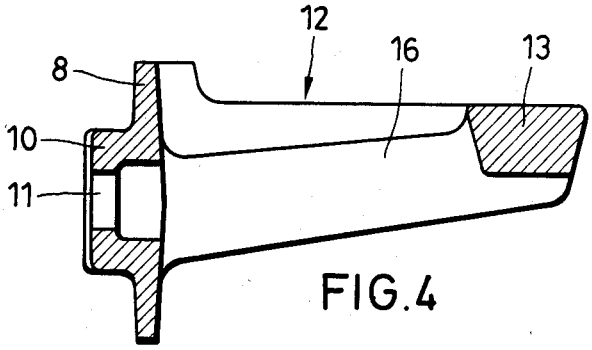
Figure 5:
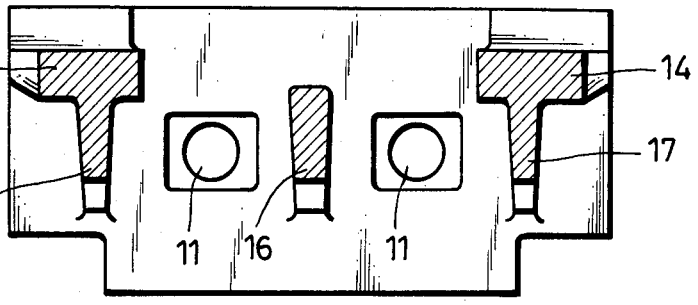
Figure 6:
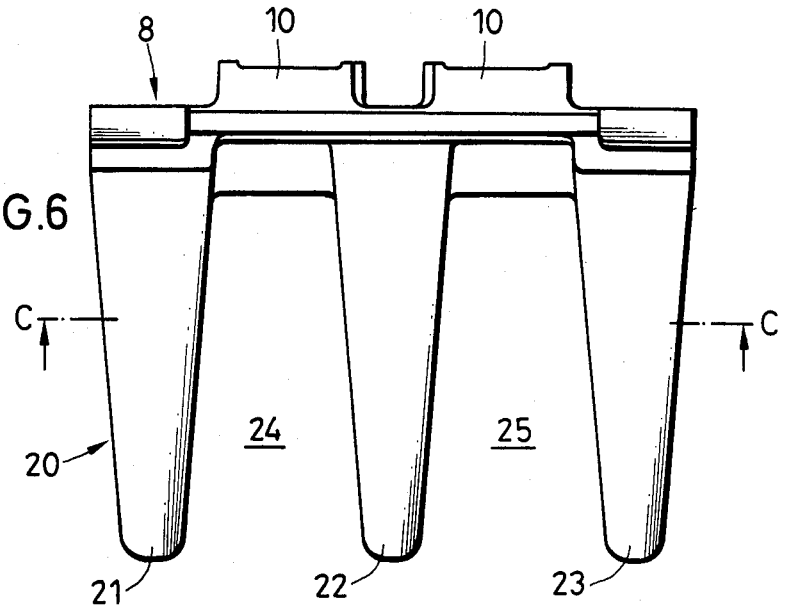
Figure 7:
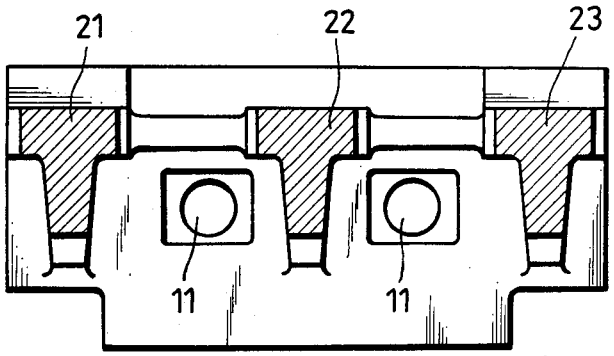

FIG. 1 shows a partial section through the shell of a pipe cooler provided with the lifting element according to the invention, FIG. 2 shows a plan view of the carrier portion of an embodiment of the lifting element according to the invention, FIG. 3 shows a view of the lifting element in the direction of arrow 3 in FIG. 2, FIG. 4 shows a section through line A—A in FIG. 3, FIG. 5 shows a section through line B—B in FIG. 2, FIG. 6 shows a plan view similar to FIG. 2 of a second embodiment of the lifting element according to the invention, whose carrier portion comprises tines, and FIG. 7 shows a section through line C—C in FIG. 6.

In FIG. 1 is shown part of a shell 1 of a pipe cooler, which comprises an outer casing 2 made of steel and lined on the inside with refractory material 3. Connected to the shell 1 are lifting elements 5 which are screwed by fixing bolts 6 onto a mounting 7 which is supported on the inside of the casing.

The partial section according to FIG. 1 relates to a breaker zone located near the inlet of a pipe cooler.

Each lifting element has a mounting portion 8 and a carrier portion 9 extending almost perpendicularly thereto. These two portions 8,9 give the lifting element an essentially L-shaped configuration.

The mounting portion 8 is provided here with two attachments 10 which, when assembled, engage in the mounting 7. The attachments 10 are provided with holes 11 for the fixing bolts 6.

The carrier portion 9 in the embodiment according to FIGS. 1 to 4 is defined by a breaker frame 12 which has a central portion 13 and, adjoining the latter, two arms 14 diverging towards the mounting portion 8. The breaker frame 12 thus defines, together with the mounting portion 8, an aperture 15.

A rib 16 which originates at the mounting portion 8 and extends as far as the central portion 13 of the breaker frame 12 divides the aperture 15 into two equal parts. Furthermore, supporting ribs 17 are provided which also originate at the mounting portion 8 and support the arms 14 of the breaker frame 12.

The upper surfaces of the central portion 13 and of the arms 14 are located essentially in one plane, while the surface of the rib 16 is downwardly offset from them.

The lifting element is a casting made in one piece from heat-resistant steel.

If a lifting element of this kind is installed in the breaking zone of a pipe cooler, no fine material can accumulate on this lifting element, as such material falls through the aperture 15. Consequently the breaker frame 12 remains free and is therefore adapted to entrain existing lumpy material to be cooled, which then falls off the carrier portion 9 from an elevated position and strikes the central portion 13 of a lifting element which is in the line of fall at the time, and can thus be broken and comminuted.

FIGS. 6 and 7 relate to a further embodiment of the lifting element according to the invention, which differs from the embodiment described above only in the design of the carrier portion 20. The carrier portion 20 here is formed by a total of three tines 21–23 which originate at the mounting portion 8, and of which the outer tines 21, 23 converge slightly, starting from the mounting portion 8. Between the tines 21–23, apertures 24, 25 are left free, through which fine material can fall in order to allow sufficiently reliable entrainment of lumpy material with this embodiment as well.

I claim:

1. A lifting element for particulate material ranging in size between large lumps and small particles, said lifting element being mountable on the interior of a rotary shell of means for cooling said particulate material, said lifting element including a mounting portion which can be fixed to the rotary shell and a carrier portion connected to said mounting portion and extending essentially perpendicularly inward of said rotary shell, said carrier portion having at least one aperture passing therethrough and said aperture being of sufficiently large dimension so that smaller particles or particulate material pass through said aperture to prevent the lifting of said smaller particles by said carrier portion so that said carrier portion lifts substantially only large portions of said particulate material in response to rotation of said rotary shell and wherein the carrier portion is of fork-like construction, including at least two tines connected to and extending outwardly from said mounting portion and between which said aperture is located.

2. A lifting element for particulate material ranging in size between large lumps and small particles, said lifting element being mountable on the interior of a rotary shell of means for cooling said particulate material, said lifting element including a mounting portion which can be fixed to the rotary shell and a carrier portion connected to said mounting portion and extending essentially perpendicularly inward of said rotary shell, said carrier portion having at least one aperture passing therethrough and said aperture being of sufficiently large dimension so that smaller particles or particulate material pass through said aperture to prevent the lifting of said smaller particles by said carrier portion so that said carrier portion lifts substantially only large portions of said particulate material in response to rotation of said rotary shell and wherein the aperture of the carrier portion is encompassed by an essentially U-shaped breaker frame having two arms originating at and connected to the mounting portion.

3. A lifting element according to claim 2, additionally including rib means dividing said aperture into two aperture portions.

* * * * *